US007677239B2

(12) United States Patent
De Miranda Grieco

(10) Patent No.: US 7,677,239 B2
(45) Date of Patent: Mar. 16, 2010

(54) KITCHEN-RANGE, AN OVEN AND A SELF-CLEANING ASSEMBLY

(76) Inventor: Antônio Augusto De Miranda Grieco, Rua dos Franceses, 174/161 B, Bela Vista, 01329-010, São Paulo-SP (BR)

( * ) Notice: Subject to any disclaimer, the term of this patent is extended or adjusted under 35 U.S.C. 154(b) by 630 days.

(21) Appl. No.: 10/551,617

(22) PCT Filed: Apr. 1, 2004

(86) PCT No.: PCT/BR2004/000049

§ 371 (c)(1),
(2), (4) Date: Jan. 26, 2007

(87) PCT Pub. No.: WO2004/088208

PCT Pub. Date: Oct. 14, 2004

(65) Prior Publication Data

US 2007/0157920 A1 Jul. 12, 2007

(30) Foreign Application Priority Data

Apr. 3, 2003 (BR) ..... 0300856
Oct. 6, 2003 (BR) ..... 0304574

(51) Int. Cl.
*F24C 15/10* (2006.01)

(52) U.S. Cl. ..... 126/211; 126/299 E; 134/108; 134/111

(58) Field of Classification Search ..... 134/115 R, 134/108, 111, 201; 126/41 R, 299 E, 211, 126/273 R
See application file for complete search history.

(56) References Cited

U.S. PATENT DOCUMENTS 2,758,588 A * 8/1956 Lozano ..... 126/1 R
3,059,632 A * 10/1962 Rogers ..... 126/37 R
3,329,529 A * 7/1967 Lamar ..... 134/22.18
3,373,754 A * 3/1968 Squire ..... 134/58 D
3,986,891 A * 10/1976 Rumbaugh ..... 134/58 D
6,405,738 B1 * 6/2002 Clark et al. ..... 134/115 R
6,895,957 B2 * 5/2005 Yeung ..... 126/299 E

FOREIGN PATENT DOCUMENTS

FR 2 208 626 6/1974

OTHER PUBLICATIONS

International Search Report.

* cited by examiner

*Primary Examiner*—Kenneth B Rinehart
*Assistant Examiner*—Chuka C Ndubizu
(74) *Attorney, Agent, or Firm*—TraskBritt

(57) ABSTRACT

The present invention relates to a kitchen-range (1) and/or an oven (100) with a self-cleaning system, having a cleaning-element spraying assembly (6, 7, 106, 107), preferably water with detergent, arranged at the cooking top (13) and/or cooking chamber (113) for spraying it in a pressurized way and removing the existing dirt. A circuit is coupled to the cooking top (13) and/or cooking chamber (113), formed by conduits (5, 105, 4, 104) and a pump (19), so that the sprayed cleaning-elements can circulate and remove dirt from the surfaces to be cleaned.

12 Claims, 5 Drawing Sheets

KITCHEN-RANGE, AN OVEN AND A SELF-CLEANING ASSEMBLY

FIELD OF THE INVENTION

The present invention relates to a kitchen-range, an oven and a self-cleaning assembly.

DESCRIPTION OF THE PRIOR ART

The cleaning of kitchen-ranges and ovens, especially those used for cooking foods, is a part of the daily life of cooks and their assistants. Thus, the prior art presents some kitchen-ranges and ovens with systems designed for facilitating this cleaning.

An example of these kitchen-ranges has a self-cleaning oven, the surfaces of which have combinations of texture and oxidizing agents that dissipates fats in the presence of heat. However, it can be noted that this system is restricted to removals of small amounts of fats from oven surfaces, so that it does not remove other elements that usually dirty kitchen-range surfaces such as residues of sauces or food.

Thus, if there is a need to remove larger amounts of fats or other elements deposited on the surfaces of kitchen-ranges and ovens, this should be done manually.

Another example of the prior art presents movable grates and trays, which may be withdrawn from the kitchen-range or oven and washed outside. However, there is the drawback of removing a few components of the kitchen-range or oven, in order to wash and dry them outside.

OBJECTIVES OF THE INVENTION

A first objective of the present invention is to provide a kitchen-range with a self-cleaning system, which, when actuated, removes liquids and solids spilled onto their cooking top.

A second objective of the present invention is to provide a kitchen-range with a self-cleaning system, which dispenses with both manual cleaning and withdrawal of trays and grates to clean them outside.

A third objective of the present invention is to provide an oven with a self-cleaning system, which, whenever actuated, removes liquids and solids spilt into the cooking chamber.

A fourth objective of the present invention is to provide an independent self-cleaning system that can be coupled to a kitchen-range or an oven.

A fifth objective of the present invention is to provide an oven which is capable of cleaning dishes and other utensils.

A sixth objective of the present invention is to provide a kitchen-range and an oven that can receive cleaning liquids from an external system, such as an independent dishwasher.

SUMMARY OF THE INVENTION

The present invention achieves theses and other objectives by means of the type that has a cooking top having at least one heating device, such as a gas-outlet nozzle, and on which a support means, especially a grate is arranged. This cooking top further has an inclined surface for the purpose of causing the cleaning elements, which are preferably cleaning liquids such as water containing detergent, to flow into a pouring opening. In addition, a cover is provided for covering this surface at least partly.

One can see that the cooking top may preferably embrace the heating device, the support means, the inclined surface, the cover and other surfaces of the upper portion of the kitchen-range.

In order to spray cleaning elements onto the cooking top, a cleaning-element assembly, preferably arranged at the cover (although it may be installed at other places of the cooking top), is preferably provided with fixed and movable sprayers (spraying arms).

The pouring opening of the inclined surface is connected to propelling means, which may be a pump or any other known propelling means, through at least one first conduit. At least one second conduct connects these propelling means to the spraying assembly, so that the first conduit, the propelling means, the second conduit form cleaning-element re-feeding circuit. In other words, when the propelling means are functioning, the cleaning element is propelled for circulation through this circuit and cleaning the surfaces of the cooking top.

Although preferred embodiments use liquids as cleaning elements, one may also use vapors without departing from the scope of the present invention.

The cleaning element is supplied and withdrawn form the circuit, respectively, by means of supplying and drain valves, which respectively connect the circuit to an external source (for example, an external hydraulic system) and to an external draining means (for example, a sewage network). These valves may alternatively be hydraulic pumps or any other known propelling means.

In order to open and close the valves, as well as to turn on and off the propelling means, control means are provided, which are preferably electronic circuits and/or electromechanical timers.

Thus, when there is a need to clean the cooking top, the control means are actuated, which command the opening of the cleaning-elements supplying valves, to supply them to the conduit. Preferably, after a predetermined amount has been supplied, the valve is closed and the propelling means are actuated, so that the cleaning elements can circulate through the circuit to remove dirt from the cooking top. After a predetermined period of time, these control means command the turning-off of the propelling means and the opening of the draining valve, so that the cleaning elements and the dirt will be forced out of the circuit, as follows:

The present invention also provides an oven of the type that comprises a cooking chamber with heating devices, support means, especially grates, arranged inside the chamber, and a cover. In the present case, term oven may optionally embrace an oven coupled to a housing or an independent heater. In addition, the heating devices may comprise gas burners, electric resistances, microwaves, among others, without departing from the scope of the present invention.

As in the kitchen-range of the invention, the oven comprises a cleaning-element spraying assembly, which may contain fixed or movable components arranged inside the cooking chamber and a base surface with an inclination that enable the sprayed cleaning elements, especially water containing detergent to flow into an opening. The spraying assembly preferably consists of fixed sprayers and a rotary spraying arm, which are fixed to the internal portion of the cooking chamber of the oven. In addition it has at least one first conduit connecting the opening to the propelling means, and at least one second conduit connecting the propelling means to the spraying assembly, so that the first conduit, the propelling means and the second conduit form a cleaning elements re-feeding circuit.

Attention is called to the fact that the expression "propelling means" may embrace, for example, a single pump or several pumps functioning independently for the kitchen-range and for the oven. Anyway, if the oven is part of the kitchen-range of the invention, the cleaning-element circuits of both will preferably be actuated by common propelling means. Moreover, said housing or heater may also comprise these propelling means.

In addition, the present oven may use the same cleaning-element supplying and drain valves, as well as control means, already described for the kitchen-range, or exclusive and independent valves and means for the oven circuit.

A self-cleaning and independent assembly that may be coupled to a cooking apparatus, especially a kitchen-range and/or an oven, is also provided by the present invention. In other words, embodiments might provide the user with an option of acquiring a kitchen-range preferably with an inclined cooking surface and an opening for the cleaning elements to flow, a special cover, a housing for receiving control systems and other functional/operational systems such as pumps, level and water-temperature controllers, and later acquiring a kit to be installed to provide the apparatus with self-cleaning.

Thus, in a the preferred embodiment this kit might have at least one first conduit capable of connecting a pour opening on said cooking apparatus to propelling means, and at least one second conduit capable of connecting the propelling means to a spraying assembly on the cooking apparatus, so that the opening, the first conduit, propelling means, the second conduit, the spraying assembly will form a cleaning circuit. In addition, cleaning-element supplying and drain valves might be provided for connecting an external source to said circuit and the circuit to an external draining means, respectively.

In view of the foregoing, when there is a need to clean kitchen-ranges and/or ovens, the control means are actuated, preferably by means of a button, commanding the opening of the cleaning-element supplying valve, which releases the entry of a determined amount thereof into this circuit. After the entry of this determined amount, these control means command the closing of the valve and the actuation of the propelling means, so that the cleaning elements received can be propelled to the spraying means and, consequently, sprayed onto the cooking top of the kitchen-range and/or the internal part of the cooking chamber of the oven. After a predetermined period of time has passed, the control means turn off the propelling means and open the drain valve, enabling the cleaning elements and the dirt to be removed from the cooking top and/or the internal chamber of the oven. It can be noted that, in different embodiments of the present invention, various cleaning cycles may be carried out, until the dirt has be totally removed from the cooking top and/or internal chamber of the oven.

Therefore, the present invention provides automation of the cleaning of theses cooking tops and internal chambers of kitchen-ranges and ovens, independently of the nature and of the amount of residues deposited thereon.

It is further pointed out that dish and kitchen utensils may be accommodated inside the oven chamber to be washed simultaneously with the cleaning thereof. Alternatively, another independent housing, connected to the assembly of the present invention, may be used for dish washing.

BRIEF DESCRIPTION OF THE DRAWINGS

The present invention will now be described in greater detail with reference to the examples represented in the figures, as follows.

DETAILED DESCRIPTION OF THE FIGURES

Figure 1:
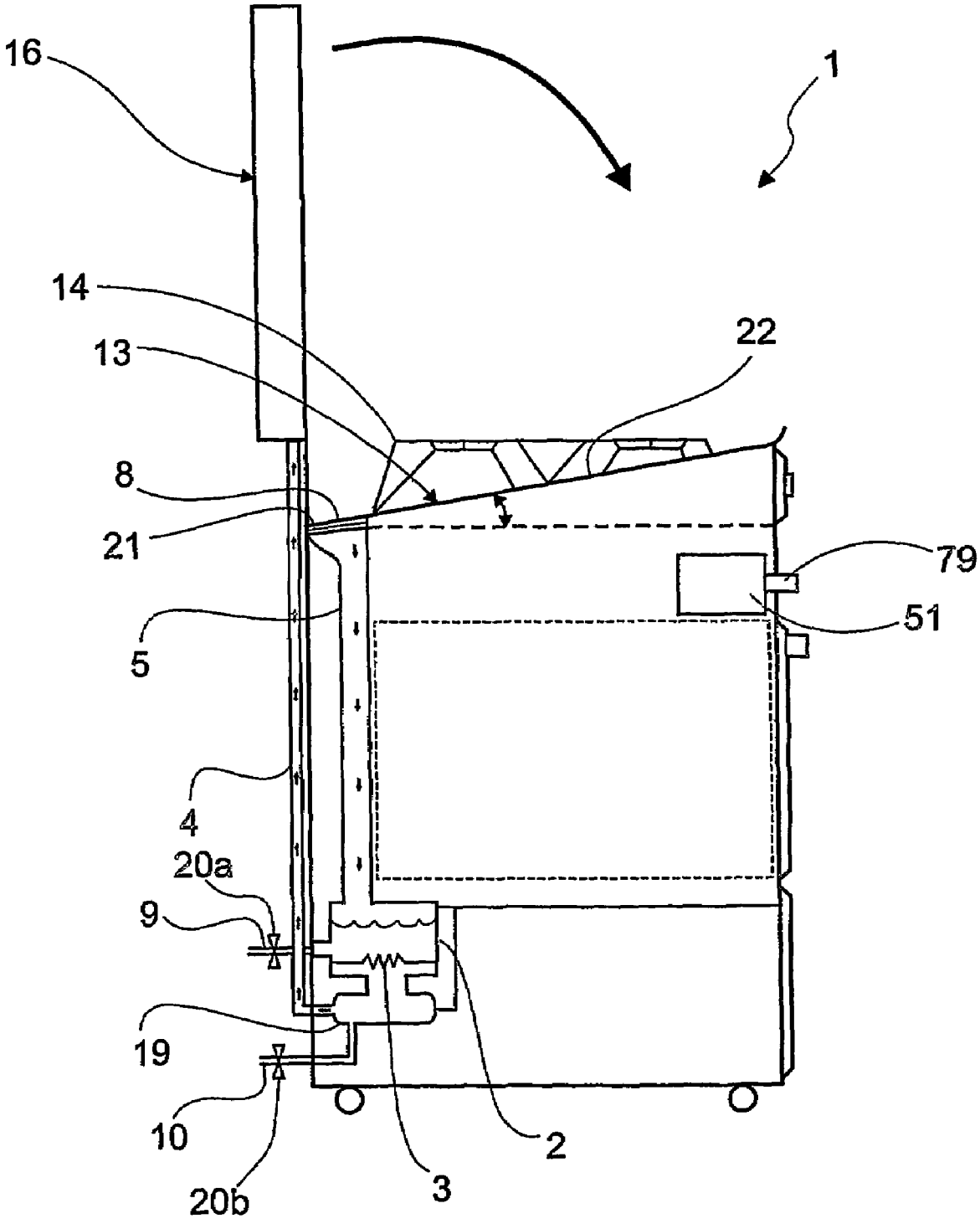
FIG. 1 shows a cross-sectional view of a first embodiment of the present invention.
Figure 2:
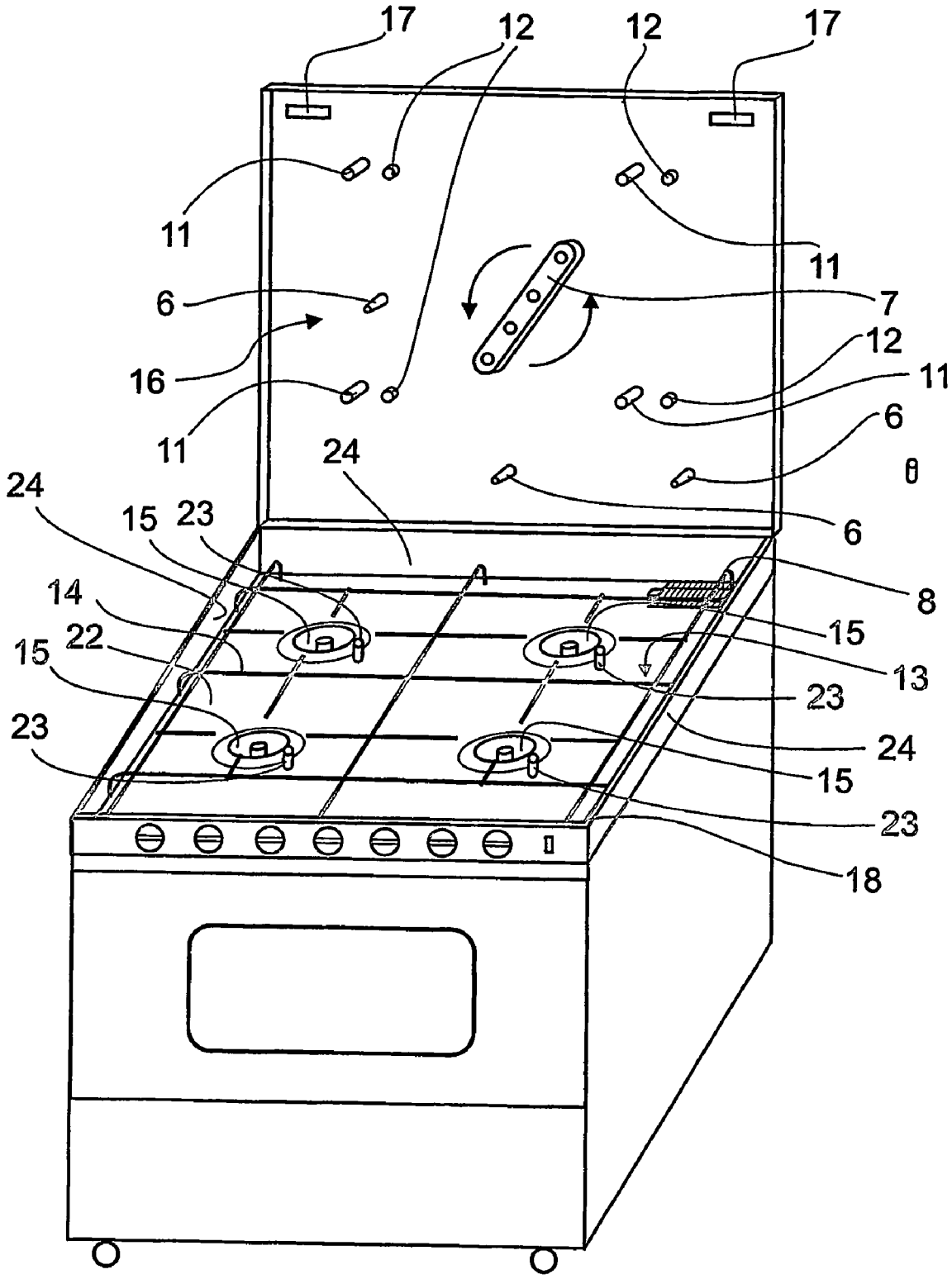
FIG. 2 shows a perspective view of the embodiment illustrated in FIG. 1.

FIGS. 1 and 2 show a preferred embodiment of the present invention, which consists of a kitchen-range 1 of the type that has a cooking top 13 and an oven (not shown), the cooking top having gas burners 15 with respective electric igniter 23 of the types known from the prior art, a grate 14 made of a metallic material and arranged on the cooking top for supporting cooking pots and other objects (not shown) to be heated, and a glass cover 16 hinged at one of the ends of the flat top to cover the surfaces 22, 24 when it is closed. Although in this embodiment the grate is of a metallic material and the cover is of glass, other materials may be used without departing from the scope of the present invention.

Although this preferred embodiment has burners that provide heating by burning gas, other embodiments might have different burners and/or heat-generating sources.

Coupled to the present kitchen-range 1, there is a self-cleaning system that, when actuated, enables one to remove dirt from the cooking top 13 by means of the circulation of cleaning elements, which preferably consist of water mixed with detergent. Other elements, including vapors, may be used without departing from the scope of the present invention.

A first liquid-spraying system is provided at the cover 16 of the stove 1, consisting of fixed sprayers 6 (small nozzles) and a rotary spraying arm 7 (a rod articulated at the stove cover), both being of a metallic material (although other materials may be alternatively used, for example polymers), for the purpose of pouring water with detergent onto surfaces of the cooking top 13. Preferably, the rotary spraying arm 7 is driven by the force of water, although other electromechanical means may be employed, such as electric motors (not shown). In addition, although the spraying arm in this preferred embodiment is rod-shaped, other embodiments might have arms with other shapes and/or including accessories, such as brushes, to help in the cleaning process.

Although the elements of the spraying system of this embodiment are located at the stove cover, in other embodiments they might be arranged at other places, as long as they could provide spraying of the water over the cooking top and would comprise only fixed sprayers or only movable sprayers.

The cooking top 13 has an inclined surface 22 and side surfaces 24, which comprise metallic base plates, although other means and materials may be used, so that the water can flow across the inclined surface 22 into an opening 8, where there is a removable collecting screen filter 21. Preferably, the opening 8 and the filter 21 are located at the lowest part of the surface 22 of the cooking top 13, so that the water can flow by gravity towards them, and the residues or solid dirt (removed from the surfaces of the cooking top) can be retained and removed later, when the filter is withdrawn. In other embodiments of the present invention, one may optionally use a self-cleaning filter or simply suppress the filter (as will be seen later, the water is subsequently led to an external drain network).

Moreover, the grate 14 of the cooking top 13 is built so as to compensate for the inclination of the inclined surface 22, being substantially parallel to the horizontal plane, in order to provide an adequate support for the cooking pots and other objects to be heated on the stove. By virtue of the fact that the inclined surface may have other shapes and inclinations in alternative embodiments of the present invention, the grate may alternatively use other support point of the stove, as for example, the sides of the cooking top.

In alternative embodiments, where this grate is dispensed with, the cooking pots and other utensils may be directly supported on the cooking surface (as in the case of stove with vitroceramic cooking surfaces, for instance). In these cases, the regions where such utensils are effectively supported may have a less steep inclination and a rougher surface to prevent the objects from sliding.

Connected to the opening 8 and to the filter 21, there is a drain conduit 5 of a polymeric material, which leads the water sprayed over the cooking top 13, by the action of gravity, into a small plastic reservoir 2. The drain conduit 5 connects the filter 21 to a water pump 19, which in turn is connected to the water spraying system (fixed sprayers 6 and rotary spraying arm 7) through another conduit 4 of a polymeric material, also called spray conduit. Consequently, the filter 21, the drain conduit 5, the pump 19, the spray conduit 4, the spray system and the inclined surface 22 form a cleaning-liquid circuit. In other words, when the pump 19 is functioning, the water is propelled to circulate through this circuit, removing dirt from the cooking top 13.

Although the materials used in this preferred embodiment are those presented above, for the conduits and the reservoir other materials might be used without departing from the scope of the present invention. Moreover, the reservoir itself, in alternative embodiments, might be suppressed.

It should be further noted that, although the pump 19 used in the present embodiment is of the type that circulates the water and promotes drain thereof, other pumps or liquid-propelling means might be used without departing from the scope of the present invention. Particularly, one might alternatively use two pumps, one to promote the circulation and the other to promote the draining.

The reservoir 2 further has a heating element 3 to heat the water and facilitate the removal of dirt form the surfaces to be cleaned. In this embodiment, this element consists of an electric resistance, but in other embodiments it might be a gas device or another heat-generating source. One might even use the heat generated by the oven itself for raising the water temperature or the heat generated by the elements that heat the cooking top (as for example, in the cases of electric ranges).

The water is supplied and withdrawn from the circuit by means of admission conduits 9 and drain conduit 10, which are preferably hoses of polymeric material (although other types of conduits may by used) and are connected to the external water network by means of valves 20*a* and 20*b*. Alternatively, pumps may be used together with or in replacement of the valves, to supply and withdraw water from the circuit.

Vents or openings 17 are provided at the cover 16 for exit of vapors from the cleaning process. Although the vents 17 are located at the cover, in this preferred embodiment, other vents might be arranged in other regions of the kitchen-range to permit evaporation of the liquids used in the cleaning and subsequent drying of the cleaned regions.

In addition, protectors 11 and 12 are made of a polymeric material, although other materials and shapes are possible. In other examples of the invention, are provided at the cover 16, to prevent the water from getting into the gas burners 15 and into the electric igniters 23 of the cooking top. The protectors or stoppers serve to close the ends of the conduits that lead the gas (in the case of gas ranges) to the burners and, consequently, to prevent water, coming from the cleaning process, from getting into the gas circuit. Alternatively, the nozzles and burners themselves may have constructive shapes that prevent water from getting into the gas circuit. Anyway, in the present embodiment, one should note that before closing the cover, the burners should be withdrawn so that the stoppers can adequately close the conduits (not shown) that lead gas to said nozzles. The protectors 12 function as protecting covers for the electric igniter 23, preventing contact thereof with the water, at the time of the self-cleaning operation. One also foresees the possibility of providing an internal system in the gas conduits for blocking the entry of water from the washing process into the gas circuit.

Figure 3:
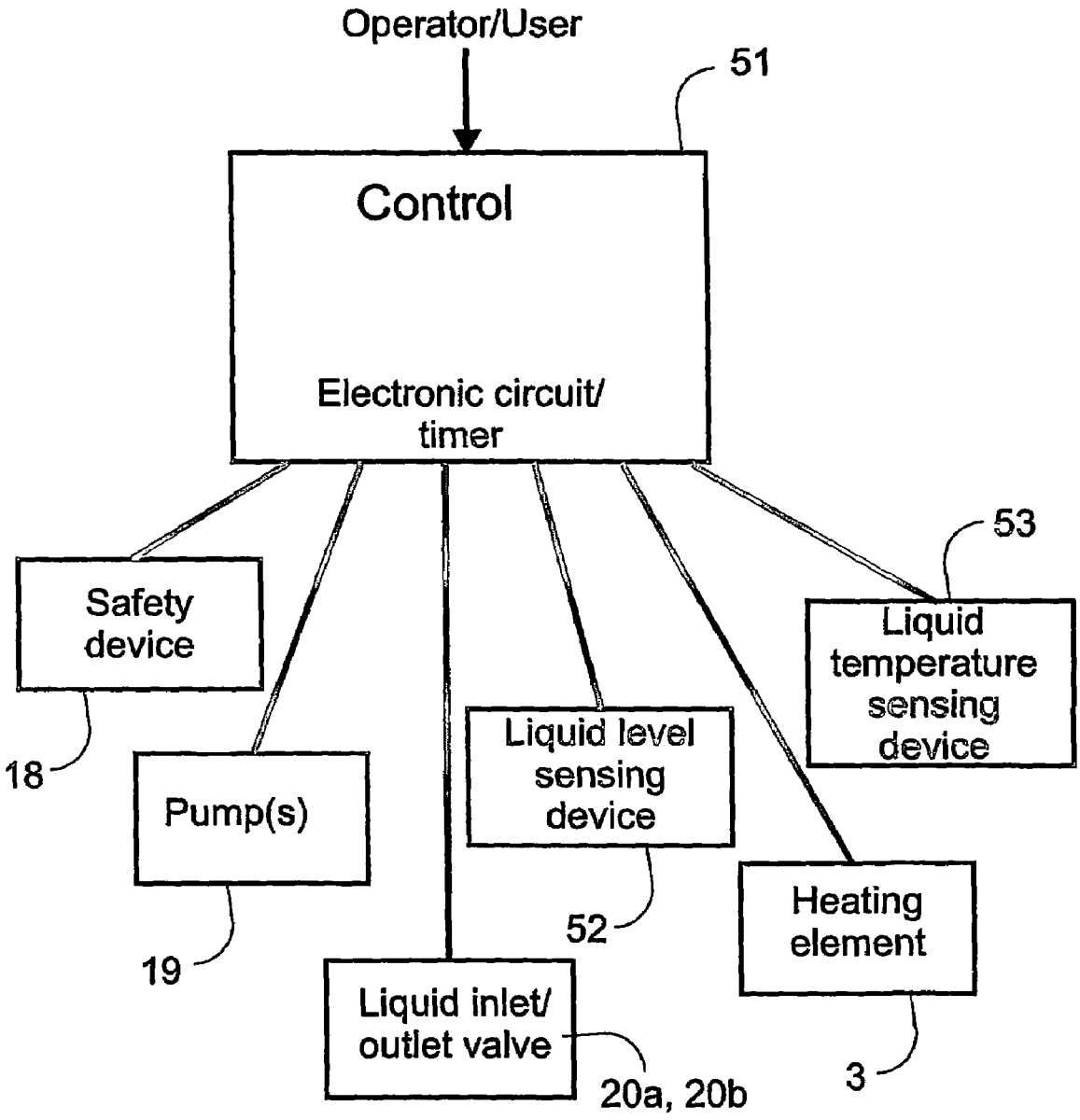
FIG. 3 shows a schematic diagram summarizing the control/automation system of the embodiment illustrated in FIG. 1.

As illustrated in FIG. 3, the self-cleaning assembly of the present invention is actuated by an automation/control system 51 that consists of an electromechanical timer or an electronic circuit. This automation/control system 51 is connected to a security device 18, to a liquid-level sensing device 52, to a liquid-temperature device 53, to the pump 19, to the valves 20*a* and 20*b*, and to the heating element 3.

The security device 18 consists of a switcher (not shown) of the type known from the prior art that, if the cover 16 is opened, interrupts the cleaning process. However, other security mechanisms may be used, be it at the cover or at other places of the range, without departing from the spirit of the present invention.

The liquid-level sensing device 52 consists of a pressostat (manostat), although one may alternatively use an electronic circuit, a level sensor or a buoy, has the function of controlling the water level in the reservoir 2, at the time of supplying water and draining it from the range 1.

The control water-temperature controlling system 53 consists of a thermostat or an electronic circuit and has the function of giving a command for the water-heating process to be interrupted when the water reaches a pre-established temperature.

Thus, on the basis of the above devices, the automation/control system 51 commands the turning-on and turning-off of pump 19, of the valves 20*a* and 20*b* and of the heating element 3 in the operation of cleaning the kitchen-range. In other words, when the user closes the cover 16 of the range 1 and turns on the automation/control system 51 by means of a button 79, the valve 20*a* is opened, so that the water from the external water network is admitted through the conduit 9 into the reservoir 2. Once the pre-established water level in the reservoir 2 has been reached, the system 51 emits a command for closing the water inlet valve 20*a*, thus discontinuing the entry of water. Then, this system 51 actuates the pump 19, initiating the circulation of water within the range-cleaning circuit. The water of the reservoir 2 is poured into the pump 19 to be propelled. The water flows through the conduit 4, which connects the water pump, as far as the cover 16 of the kitchen-stove, where the water sprayers are located, directed to the top surface to be washed. In this way, the fixed sprayers 6 and the rotary spraying arm 7 spray the water over the cooking top 13 in a pressurized way (the cleaning is provided by the mechanical action of the water on the surface, plus the chemical action of the detergent-containing water). After the pressured water is sprayed onto the cooking top 13, it flows across the top surface as far as the filter 21, to be led through the conduit 5 and by the force of gravity into the water reservoir 2, where it is heated up to a pre-established temperature to facilitate the removal of dirt from the surfaces. During this heating process, the pump 19 may remain turned on in order to keep the water circulating and cleaning the cooktop 13 of the range 1. When the thermostat 53 indicates that the water has reached the predetermined temperature, the system 51 emits a command for turning of the heating element 3. It should be noted that, although the water is heated in the preferred embodiment, another embodiment might use cold water or receive hot water from the external network, without departing from the scope of the present invention.

After this cycle is carried out for a predetermined period of time (generally, this period coincides with the period that the water takes to be heated up to the predetermined temperature), the automation/control system 51 emits a command for opening the draining valve 20*b*, so that the pump 19 will drain the water out of the circuit through this draining valve 20*b* to an external sewage network. Attention is called to the fact that, after this, the automation/control system 51 may optionally emit a new command for opening the water inlet valve 20*a*, so as to receive water from the network again, for rinsing the range surfaces to be cleaned. In this way, after the water has reached the predetermined level within the reservoir 2, the same cleaning process is repeated, and one may or may not turn on the heating element 3. Once the pre-established water circulation period has finished, the water is drained by the above described process. It should be noted that this rinsing cycle may be repeated several times, until an adequate result is achieved. In the last rinsing process, one may include a surfactant liquid (for example, a brightening dryer, a drying liquid, among others), which is introduced into the process by means of a dispenser for this purpose (not shown), in order to prevent sprinkling onto the top surface 13. Moreover, water is preferably heated so that one can dry the rinsed surfaces by evaporation (through the vents 17 in the cover 16), the remaining water being drained by the pump 19, after which the automation/control system 251 turns off the equipment. Optionally, the drying of the cleaned surfaces may be effected by other principles, as for example, ventilation.

Figure 4:
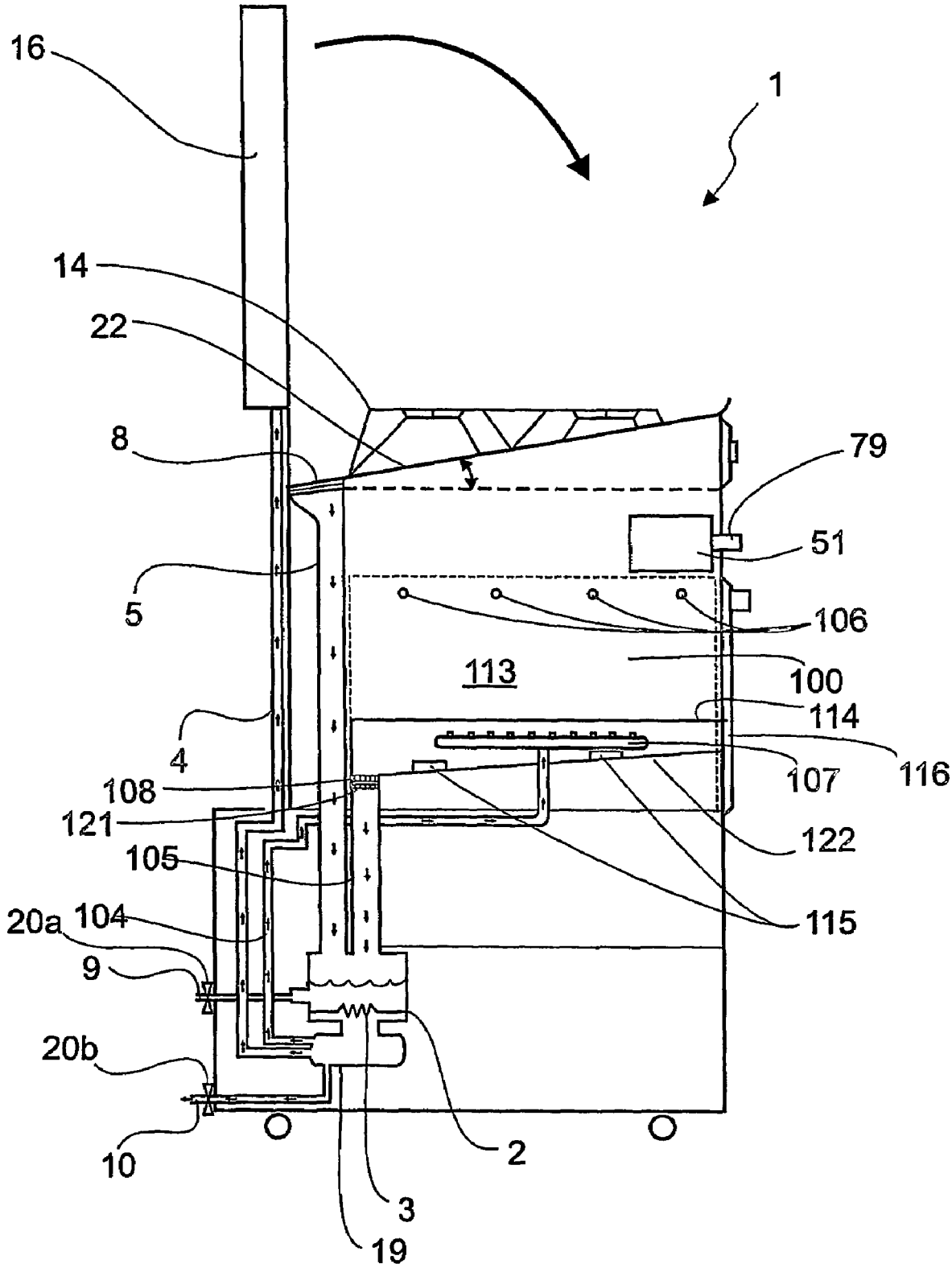
FIG. 4 shows a cross-section view of a second embodiment of the present invention.

FIG. 4 illustrates a second embodiment of the present invention, in which the self-cleaning system for cleaning the range 1 also embraces the oven 100.

In this embodiment, one can see that a second spraying system is provided within the oven, including, just as the cooking top 13, a rotary spraying arm 107 (it may also include fixed sprayers 106). Although this spraying system is arranged as illustrated in FIG. 4, the spraying arm might be arranged in other positions, as well as comprise fixed sprayers.

A second flow conduit 105 connects an opening 121 to a filter 108 of an inclined surface 122 of the oven 100 to the water pump 19, which in turn is connected to the second water-spraying system by means of another spraying conduit 104. Consequently, the filter 108, the second flow conduit 105, the pump 19, the second spraying conduit 104, the spraying system and the inclined surface 122 form a second cleaning-liquid circuit that works in parallel with the first cleaning-liquid circuit described above. In other words, when the pump 19 is functioning, the water propelled to circulate through these two circuits, removing the dirt from the coking top 13 and from the internal region of the cooking chamber 113.

In addition, the processes of admitting and draining liquids, as well as the control means, may be the same for the cooking top and for the cooking chamber or separated and functioning independently. Consequently, there may be control and propulsion systems functioning independently, to actuate the range and the oven.

The elements that compose this second circuit are substantially formed by the same materials as the first circuit and, optionally, may have the variations mentioned above.

Figure 5:
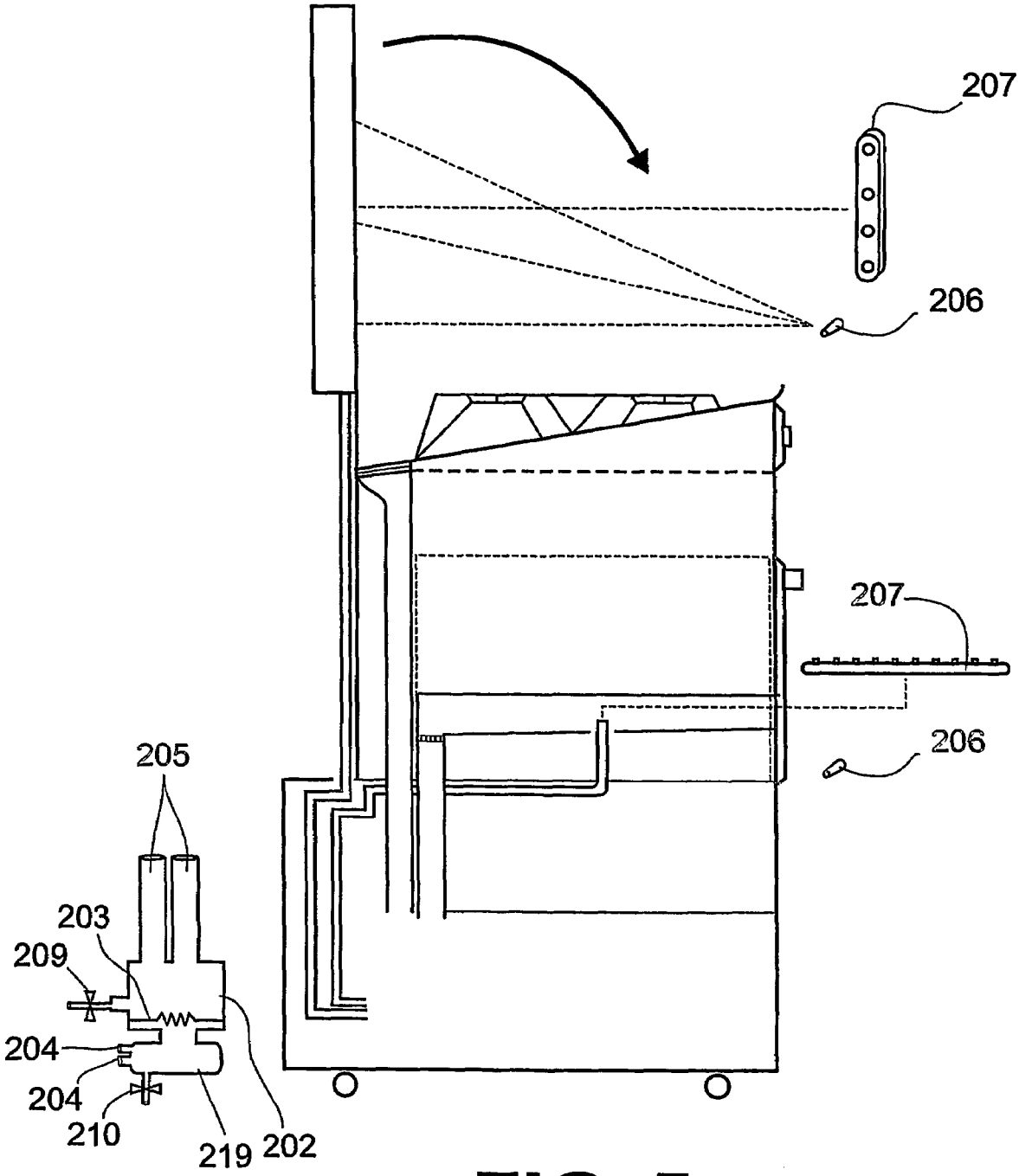
FIG. 5 shows a cross-section view of third embodiment of the present invention.

In preferred embodiments of the present invention, the self-cleaning system is incorporated into the kitchen-range, still in its manufacturing stage. However, other embodiments might consist of kitchen-ranges capable of receiving self-cleaning assemblies subsequently. In other words, the user might acquire a kitchen-range with an inclined cooking surface and an opening for draining out cleaning elements, a special cover, a housing for receiving a control system and other functional/operational systems, such as pumps, water level and temperature controllers and, later, acquire a kit/assembly (as shown in FIG. 5) containing both the functional part and the control part to be installed on the kitchen-range. In a preferred embodiment, this kit has at least one pump 219 and one reservoir 202 with a heating element 203. Moreover, elements of the spraying system, such as fixed sprayers 206 and spraying arms 207 might also be included in the kit. It should be noted that other kits might include other components, such as the conduits of the cleaning-liquid circuit.

This concept of attaching a self-cleaning assembly to the kitchen-range and/or to the oven as well embraces a cooking top without an oven.

Alternatively, the kitchen-range of the present invention might be prepared to be connected to an external dishwasher (not shown), so that the cleaning elements of the latter would also be propelled to the range in order to clean its dirty surfaces. Moreover, this system may be used with independent ovens with different forms of generating heat, such as gas, electricity, vapor or microwaves.

In addition, in other embodiments of the present invention, the cooking chambers of the ovens of the invention may include supports for table ware and dishes in general, so as to function as a dishwasher. Alternatively, the kitchen-range of the present invention may further include an additional chamber exclusively for washing dishware.

Preferred embodiments having been described, one should understand that the scope of the present invention embraces other possible variations, being limited only by the contents of the accompanying claims, which include the possible equivalents.

The invention claimed is:

1. A kitchen-range of the type that has a cooking top comprising at least one surface, wherein at least one heating device and a support means, especially a grate, are arranged, and a cover that can cover it at least partly; the kitchen-range being characterized by further comprising:

a first cleaning-element spraying assembly, arranged in the cooking top, said at least one surface of the latter being inclined with respect to the horizontal plane, so the sprayed elements can flow into a drain opening connected to a re-feeding circuit for feeding cleaning elements back to said first spraying assembly;

a cleaning-element delivering valve connecting an external source to said circuit, and a cleaning-element draining valve connecting the circuit to an external drain means; and control means to open and close the valves, enabling the cleaning elements to get into and out of the cleaning circuit, and to turn on and off said valves, initiating and finishing the circulation of the cleaning elements in the circuit.

2. The kitchen-range according to claim 1, wherein said re-feeding circuit comprises at least one first conduit connecting the drain opening to a propelling means, and at least one second conduit connecting the propelling means to the first spraying assembly.

3. A kitchen-range of the type that has a cooking top comprising at least one surface, wherein at least one heating device and a support means, especially a grate, are arranged, and a cover that can cover it at least partly; the kitchen-range further comprising:

a first cleaning-element spraying assembly, arranged in the cooking top, said at least one surface of the latter being inclined with respect to the horizontal plane, so the sprayed elements can flow into a drain opening connected to a re-feeding circuit for feeding cleaning elements back to said first spraying assembly;

a cleaning-element delivering valve connecting an external source to said circuit, and a cleaning-element draining valve connecting the circuit to an external drain means;

a control means to open and close the valves, enabling the cleaning elements to get into and out of the cleaning circuit, and to turn on and off said valves, initiating and finishing the circulation of the cleaning elements in the circuit; and an oven of the type that comprises a cooking chamber with heating devices, support means, especially grates, arranged in the chamber, and a cover to cover it, the oven comprising:

a second cleaning-element spraying assembly arranged in the cooking chamber, the base surface of the latter being inclined, so that the sprayed elements can flow to a portion where the second drain opening is arranged; and at least one third conduit connecting the second drain opening to a propelling means, and at least one fourth conduit connecting the propelling means to the second spraying assembly, so that the second opening, the third conduit, the propelling means, the fourth conduit, the second spraying conduit and the base surface will form a cleaning-element circuit.

4. The kitchen-range according to claim 1, wherein the cleaning elements are cleaning liquids.

5. The kitchen-range according to claim 1, wherein the propelling means is a pump.

6. The kitchen-range according to claim 1, wherein the cleaning-element delivering valve is connected to the entrance of the pump by means of a reservoir.

7. The kitchen-range according to claim 6, wherein the circuit comprises cleaning-element heating means.

8. The kitchen-range according to claim 1, wherein the spraying means comprises at least one spraying arm and a sprayer.

9. The kitchen-range according to claim 1, wherein the first and the second openings include a filter.

10. The kitchen-range according to claim 1, wherein the control means is selected from the group consisting of an electronic circuit, a timer, and an electronic circuit and a timer.

11. A kitchen-range of the type that has a cooking top comprising at least one surface, wherein at least one heating device and a support means, especially a grate, are arranged, and a cover that can cover it at least partly; the kitchen-range further comprising:

a first cleaning-element spraying assembly, arranged in the cooking top, said at least one surface of the latter being inclined with respect to the horizontal plane, so the sprayed elements can flow into a drain opening connected to a re-feeding circuit for feeding cleaning elements back to said first spraying assembly;

a cleaning-element delivering valve connecting an external source to said circuit, and a cleaning-element draining valve connecting the circuit to an external drain means;

a control means to open and close the valves, enabling the cleaning elements to get into and out of the cleaning circuit, and to turn on and off said valves, initiating and finishing the circulation of the cleaning elements in the circuit; and at least one pump in fluid communication with said valves.

12. A kitchen-range of the type that has a cooking top comprising at least one surface, wherein at least one heating device and a support means, especially a grate, are arranged, and a cover that can cover it at least partly; the kitchen-range further comprising:

a first cleaning-element spraying assembly, arranged in the cooking top, said at least one surface of the latter being inclined with respect to the horizontal plane, so the sprayed elements can flow into a drain opening connected to a re-feeding circuit for feeding cleaning elements back to said first spraying assembly;

a cleaning-element delivering valve connecting an external source to said circuit, and a cleaning-element draining valve connecting the circuit to an external drain means; and a control means to open and close the valves, enabling the cleaning elements to get into and out of the cleaning circuit, and to turn on and off said valves, initiating and finishing the circulation of the cleaning elements in the circuit; and wherein said first cleaning-element spraying assembly is arranged on said at least one surface of the cooking top and/or at the cover of the kitchen-range.

* * * * *